US010648300B2

(12) United States Patent
Collins et al.

(10) Patent No.: US 10,648,300 B2
(45) Date of Patent: May 12, 2020

(54) VENTING SYSTEM FOR A SHAPED CHARGE IN THE EVENT OF DEFLAGRATION

(71) Applicant: Hunting Titan, Inc., Pampa, TX (US)

(72) Inventors: William Richard Collins, Burleson, TX (US); Mark Allan Pederson, Bynum, TX (US); Ian Douglas Rudnik, Vassar, MI (US)

(73) Assignee: Hunting Titan, Inc., Pampa, TX (US)

( * ) Notice: Subject to any disclaimer, the term of this patent is extended or adjusted under 35 U.S.C. 154(b) by 612 days.

(21) Appl. No.: 14/184,001

(22) Filed: Apr. 15, 2014

(65) Prior Publication Data

US 2015/0292306 A1 Oct. 15, 2015

(51) Int. Cl.

| | |
|---|---|
| ***E21B 43/117*** | (2006.01) |
| ***F42B 1/02*** | (2006.01) |
| ***F42B 39/20*** | (2006.01) |
| ***E21B 43/1185*** | (2006.01) |
| ***E21B 43/11*** | (2006.01) |
| ***F42B 3/08*** | (2006.01) |
| ***E21B 43/116*** | (2006.01) |
| ***E21B 43/119*** | (2006.01) |

(Continued)

(52) U.S. Cl.

CPC ..... *E21B 43/117* (2013.01); *E21B 43/11* (2013.01); *E21B 43/112* (2013.01); *E21B 43/114* (2013.01); *E21B 43/116* (2013.01); *E21B 43/118* (2013.01); *E21B 43/119* (2013.01); *E21B 43/1185* (2013.01); *F42B 1/02* (2013.01); *F42B 1/028* (2013.01); *F42B 3/08* (2013.01); *F42B 12/10* (2013.01); *F42B 39/20* (2013.01)

(58) Field of Classification Search

CPC ..... E21B 43/11; E21B 43/116; E21B 43/117; E21B 43/112; E21B 43/114; E21B 43/118; E21B 43/1185; E21B 43/119; F42B 1/02; F42B 1/028; F42B 3/08; F42B 12/10

USPC ..... 102/306–310, 476; 89/1.15

See application file for complete search history.

(56) References Cited

U.S. PATENT DOCUMENTS 3,327,630 A 6/1967 Bell
4,881,445 A * 11/1989 Hayes ..... F42B 3/08 102/306

(Continued)

FOREIGN PATENT DOCUMENTS

EP 1363103 A1 11/2003

OTHER PUBLICATIONS

Notification of Transmittal of the International Search Report and the Written Opinion of the International Searching Authority, PCT Application No. PCT/US14/58993, dated Jan. 7, 2015, 7 pages.

*Primary Examiner* — Tara E Schimpf
(74) *Attorney, Agent, or Firm* — Christopher McKeon; Jason Saunders; Arnold & Saunders, LLP

(57) ABSTRACT

A shape charge venting apparatus and method for venting gases generated during deflagration. The venting apparatus and method including vent grooves inside the shape charge providing a pathway for deflagration gases to escape the shape charge. The venting apparatus and method also may include using a retainer ring in addition to the vent groove in order to hold the components of the shape charge in place. The venting of the gases during deflagration facilitates pressure relief within the shape charge and increases safety from accidental detonation during a fire.

35 Claims, 3 Drawing Sheets

(51) Int. Cl.

| | |
|---|---|
| ***E21B 43/118*** | (2006.01) |
| ***F42B 1/028*** | (2006.01) |
| ***F42B 12/10*** | (2006.01) |
| ***E21B 43/114*** | (2006.01) |
| ***E21B 43/112*** | (2006.01) |

(56) References Cited

U.S. PATENT DOCUMENTS

| | | | | |
|---|---|---|---|---|
| 6,453,817 | B1 * | 9/2002 | Markel | F42B 3/08 102/306 |
| 2003/0037692 | A1 * | 2/2003 | Liu | C06B 33/00 102/301 |
| 2003/0116049 | A1 * | 6/2003 | Han | F42B 1/02 102/306 |
| 2004/0200377 | A1 | 10/2004 | Collins et al. | |
| 2009/0050321 | A1 | 2/2009 | Rhodes et al. | |
| 2010/0011945 | A1 | 1/2010 | Loehr | |

* cited by examiner

VENTING SYSTEM FOR A SHAPED CHARGE IN THE EVENT OF DEFLAGRATION

FIELD

The invention generally relates to shaped charges utilizing explosive materials. More particularly, the invention relates to shaped charges designed primarily for perforating subterranean well casings and formations.

BACKGROUND

Generally, when completing a subterranean well for the production of fluids, minerals, or gases from underground reservoirs, a steel casing is placed into the wellbore and cemented into place. The casing provides for the ability to select zones in the wellbore to produce from. The sought after zones in the formation are accessed via explosively blasting a channel from the inside of the casing, through the casing, through the cement, and into the formation. Afterwards, subsequent completions operations are possible, including fracking, to stimulate and control the production of fluids from the formation.

Explosively perforating the formation using a shaped charge is a widely known method for completing an oil well. A shaped charge is a term of art for a device that when detonated generates a focused explosive output. This is achieved in part by the geometry of the explosive in conjunction with a liner. Typically, a shaped charge includes a metal case that contains an explosive material with a concave shape, which has a thin metallic liner. Many materials are used for the liner, some of the more common metals include brass, copper, and lead. When the explosive detonates the liner material is compressed into a super heated, super pressurized jet that can penetrate metal, concrete, and rock.

Shaped charges must be transported from a manufacturing facility to the field. The high explosives must be maintained and designed such that the risk of any premature detonation is mitigated against. Shaped charges are transported by a variety of transportation methods, in all climates and temperature ranges, and may be subject to temperature variations, vibrations, mishandling, and fire. They often have to travel across multiple legal boundaries, with varying degrees of safety requirements.

One of the safety requirements is that if the shape charge is set on fire, it will not detonate but instead will just burn or deflagrate. This requires that no pressure can build up inside of the shape charge, especially between the inner casing and the high explosive material while the explosive material is burning. Generally, obstructing materials such as retainer rings are not placed on the front face of the shape charge to hold all of the components in place as they could allow pressure to build up in the shape charge when it is deflagrating. A buildup in pressure while burning could lead to detonation of the shape charge.

Shaped charges contain many components that must be held into place effectively. Several methods for retaining the shape charge components will restrict the ability of the shape charge to vent gases in the event that the shape charge begins deflagrating due to a fire. In order to meet safety and transportation requirements, the shape charge must be designed such that if in the event the shape charge catches fire, the gases produced from the deflagration will safely vent out of the charge without substantial pressure buildup.

SUMMARY

The present shape charge comprises one or more vent grooves running along the inner surface of the shape charge. Although described as a groove or channel in the inner wall of the casing, that groove or channel could be any shape, cut, hole, or other design.

Shape charges in general have to pass specific safety tests in order to be transported, particularly over legal boundaries. Because of their high explosive nature, they are considered dangerous and hazardous. Moreover, because of the precision with which they must be manufactured and assembled, the shape charge often has to be fully assembled prior to shipping to a job site.

However, the high explosive needs to be held in place or it may become disassembled during transport as the shock and vibration may cause components to come loose. Therefore, there is a need to build retaining device that can keep the components in place, but not interfere with the venting requirements needed to meet shipping safety requirements.

One solution is to use a groove in the inner casing to provide for venting of gases generated by deflagration of the high explosives. Moreover, the groove, while useful in itself, can also be used in conjunction with a retainer ring. The ring could be designed such that there are gaps on the front face of the shaped charge even with the ring in place. For instance, the ring is sized smaller in width than the radius of the groove, which will allow for a gap where gases can escape. A wave shaped or star shaped ring could also be used that would allow the vent groove to vent gases unobstructed. The wave spring will still prevent the high explosive from moving in relation to the casing due to friction and the interference fit.

Further examples are provided herein below.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF THE DRAWINGS

In the following description, certain terms have been used for brevity, clarity, and examples. No unnecessary limitations are to be implied therefrom and such terms are used for descriptive purposes only and are intended to be broadly construed. The different systems and method steps described herein may be used alone or in combination with other systems and method steps. It is to be expected that various equivalents, alternatives, and modifications are possible within the scope of the appended claims.

Figure 1:
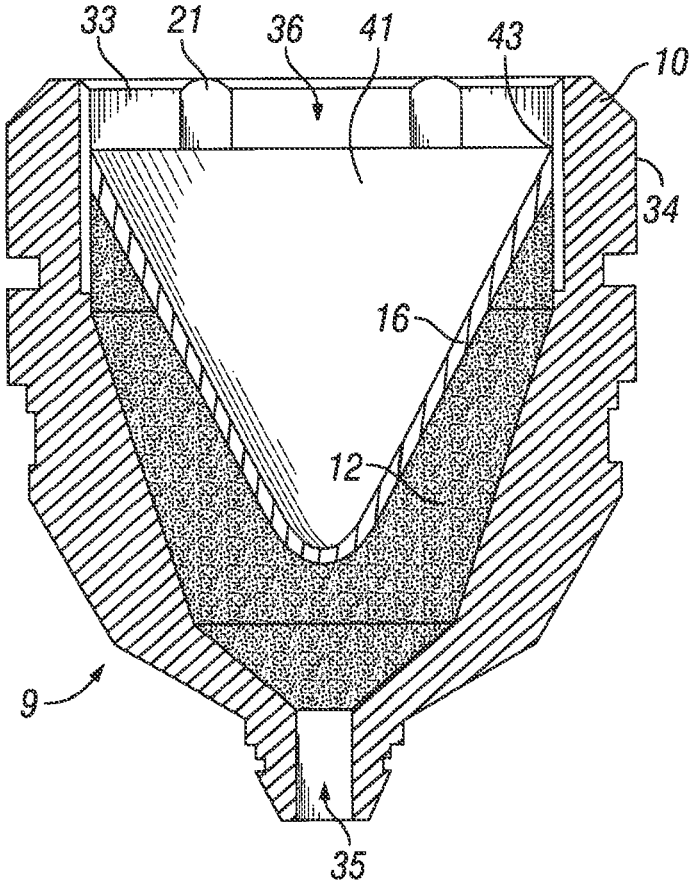
FIG. 1 is an axial cross-section of an example shape charge assembly with vent grooves.

FIG. 1 illustrates an example of a shaped charge 9 for well pipe and formation perforation. A shape charge 9 generally comprises at least a case 10, a liner 16, and an explosive material 12 placed in between the case 10 and the liner 16. The case 10 serves as a containment vessel designed to hold the detonation force of the detonating explosive material 12 long enough for a perforating jet to form from the liner 16. The perforating jet is capable of penetrating metal and/or rock. The case 10 has an inner wall 33 and an outer wall 34. The case has a relatively large open front end 36 and a smaller open primer end 35. Common materials used for the case 10 include steel, zinc, aluminum, ceramics and glass.

Explosive material 12 is contained inside the outer case 10 and integrally fills the space between the inside surface of the outer case and the external surface of a concave liner 16. The explosive charge may be detonated by a variety of methods that are well known in the art. The explosive material 12 may be one or a combination of compositions known in the art by trade designations such as HMX, HNS, PETN, PATB and HTX.

The liner 16 of a typical shaped charge is internally open. When the explosive charge 12 is detonated, the force of the detonation collapses the liner 16 into the internal space 41 and causes it to be ejected from the case 10 as a very high velocity plasma jet. The high velocity plasma jet then exits the case via the front end 36.

The liner 16 of the present invention is preferably formed from a mixture of powdered metals such as copper and lead. Other powdered metals may be included or substituted such as brass, bismuth, tin, zinc, silver, antimony, cobalt, nickel, tungsten, uranium or other malleable, ductile metals in proportions and formulations known to a person of ordinary skill in the art. It is also known to include certain plastics or polymers in the liner mixture.

Although the liner 16 is preferably formed from a mixture of powdered metals, those of ordinary skill will understand that the invention objectives may be served by a solid material form of metal alloy that is stamped, forged, machined, molded, layered or otherwise formed.

The case 10 has one or more vent grooves 21 that are drilled into the inner wall 33 of the case 10. The vent grooves 21 allow for gases to escape from inside the case to the outside of the case when the explosive material is in place. The vent hole can be a singular hole or a plurality of holes. The vent groove 21 can be cylindrical in shape, rectangular in shape, or some other shape that is well known in the art. The vent groove 21 may be manufactured by a variety of methods that are well known in the art and suitable for the materials used to make the case, including but not limited to stamping, forging, and machining.

Figure 2A:
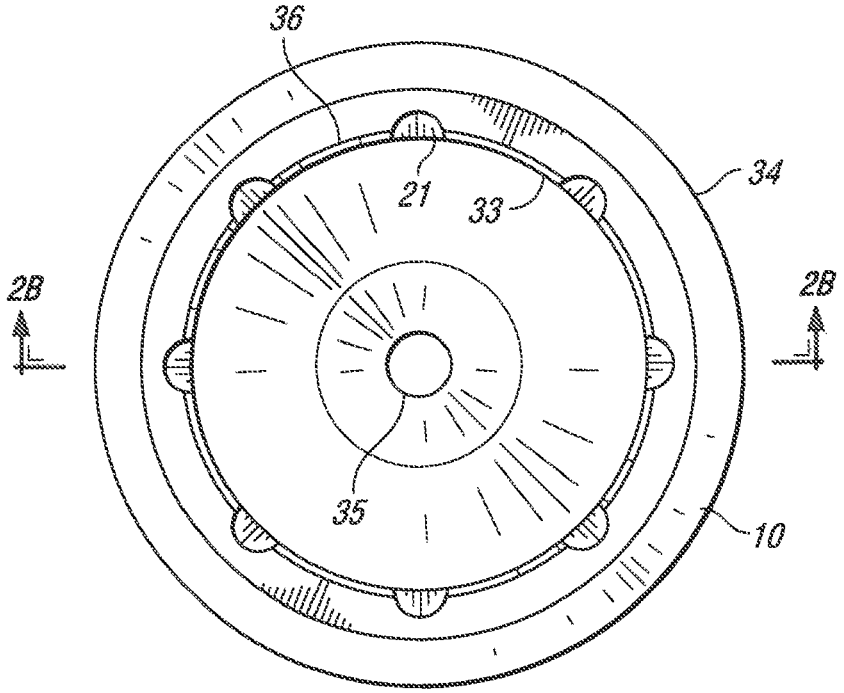
FIG. 2*a* is a top view of an example shape charge case with a vent groove.

FIG. 2*a* illustrates an example shape charge case 10 viewed from the top. The vent grooves 21 are spaced about the center axis. There is an inner wall 33 and an outer wall 34. The vent grooves 21 in this example are machined into the inner wall 33, however the vent grooves 21 may be formed by a variety of manufacturing methods including machining, stamping, forging, electrical discharge machining, or other methods known in the art.

Figure 2B:
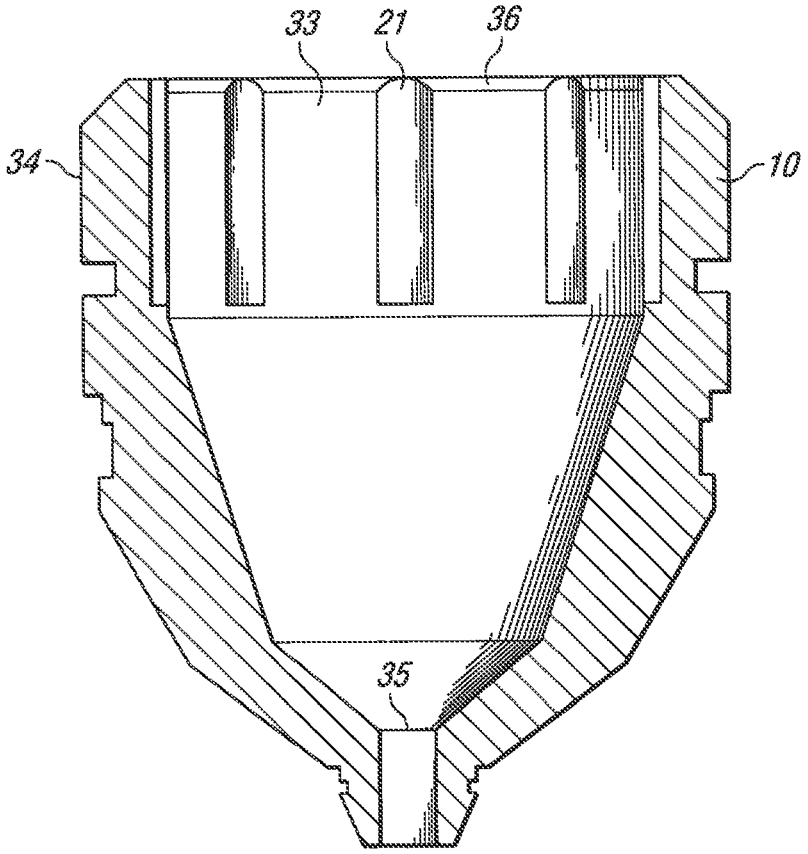
FIG. 2*b* is an axial cross-section of an example shape charge case with a vent groove.

FIG. 2*b* illustrates an example shape charge case 10 viewed as a cutaway from the side. The vent grooves 21 are machined into the inner wall 33. The vent grooves 21 are long enough such that a sufficient channel is created along the inner wall 33 in order to relieve pressure building up inside the shape charge due to heat and/or deflagration of the explosive material 12.

Figure 3:
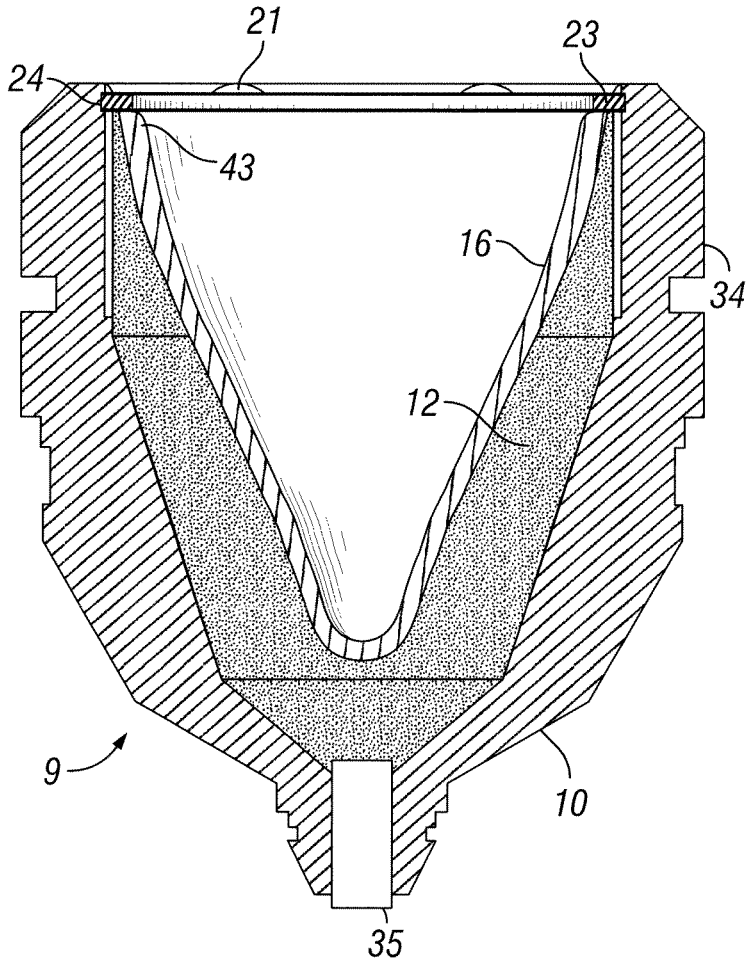
FIG. 3 is an axial cross-section of an example shape charge with a vent groove and a ring groove containing a retainer ring.

FIG. 3 illustrates an assembly with all of the components for a shape charge, including the explosive material 12 and the liner 16. FIG. 3 also shows a retainer ring 23 in place that restricts the movement of the explosive material and liner in relation to the case 10. The case has a ring groove 24 that is capable of accepting one or more rings 23 of various geometries. In at least one embodiment the retainer ring 23 has an interference fit with the ring groove 24.

In another embodiment, there is no retainer ring and instead the liner 16 is held in place by an interference fit between the liner 16 and the inner wall 33 of the case 10. In this configuration, the liner has an outer diameter that is slightly larger than the inner diameter of the case 10. The explosive material 12 is put into place and then the liner 16 is pressed in using methods well known in the art. The interference fit allows for the liner 16 to be frictionally engaged with the case 10.

In another embodiment there is no retainer ring and instead the liner 16 is held in place by an adhesive applied to the top of the liner skirt 43. The adhesive is commonly used in the art.

In another embodiment, the liner 16 is engaged to the case 10 by an interference fit between the liner 16 and the inner wall 33 of the case 10. In addition, there is a retainer ring 23 placed above the liner 16 to further hold the liner 16 and explosive material 12 in place. The retainer ring 23 is sized such that the outer diameter is larger than the inner diameter of the inner wall 33.

In another embodiment the liner 16 is held in place by a retainer ring 23 placed in the ring groove 24. The retainer ring 23 is sized such that the ring fits tightly within the ring groove 24 and prevents the liner 16 from moving axially in relation to the case 10.

In another embodiment, the liner 16 is held in place by a retainer ring 23 placed in the ring groove 24 whereby the retainer ring 23 is sized to have an interference fit within the ring groove 24, thereby preventing the liner 16 from moving axially in relation to the case 10.

In another embodiment the retainer ring 23 can be a snap ring design as commonly used by a person of ordinary skill in the art. A person of ordinary skill in the art will understand that a snap ring has a gap that allows it to be compressed or expanded in order to install as required.

In another embodiment, the retainer ring 23 can be a wave shaped ring. The wave shaped ring uses a wave design such that when it is installed in place in the ring groove 24, there will exist gaps between the wave retainer ring 23 and the ring groove 24, allowing for gases to exit the case 10 with minimal pressure buildup when exposed to heat and/or deflagration. The retainer ring 23 is installed in ring groove 24 with the explosive material 12 and liner 16 in place.

In another embodiment, the retainer ring 23 can contain one or more vent holes. These vent holes allow for the gases to exit the case 10 with minimal pressure buildup when exposed to heat and/or deflagration. The retainer ring 23 is installed in ring groove 24 with the explosive material 12 and liner 16 in place.

The material of the retainer ring 23 may include one or more of the material steel, zinc, aluminum, plastic, or a polymer. It is preferable that the material of the retainer ring 23 is the same or substantially similar to the material of the liner 16.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention. In particular, use of the terms "vent groove", "ring", "liner", "ring groove", "explosive material", "deflagration", and "vent" herein and within the claims to follow is defined expansively to encompass equivalent terms that are well known in the art.

What is claimed is:

1. A shape charge assembly comprising:

a case with at least one cylindrical opening and an inner cavity defined by an inner wall having a cylindrical portion and a concave portion;

a liner having a liner apex and a liner skirt located proximate to the inner wall;

at least one longitudinal inner facing vent groove in the cylindrical portion only, of the inner wall;

an explosive material in contact with the inner wall and in contact with the at least one vent groove;

wherein the liner skirt is adjacent to the inner wall, and the explosive material is adjacent to the inner wall and the liner; and wherein the at least one vent groove vents gases along the inner wall, around the liner skirt, and towards the cylindrical opening.

2. The assembly according to claim 1, wherein the liner skirt has an interference fit with the inner wall.

3. The assembly according to claim 1, wherein the at least one vent groove is adapted to vent gases across the inner wall.

4. The assembly according to claim 3, wherein the at least one vent groove is a plurality of vent grooves.

5. The assembly according to claim 1, wherein the at least one vent groove is adapted to prevent a high energy release during the deflagration of the explosive material.

6. The assembly according to claim 1, further comprising a retainer ring that prevents the liner from moving in relation to the case.

7. The assembly according to claim 6, wherein the retainer ring has an interference fit with the inner wall.

8. The assembly according to claim 7, wherein the at least one vent groove is a plurality of vent grooves adapted to prevent a high energy release during the deflagration of the explosive material.

9. The assembly according to claim 1, wherein the at least one vent groove is located in the inner wall such that the vent groove is adjacent to the liner skirt.

10. The assembly according to claim 9, wherein the at least one vent groove is a plurality of vent grooves.

11. A shape charge case comprising:

at least one conical cross sectioned portion with a first opening and a second opening;

at least one cylindrical cross sectioned portion having a third opening, a fourth opening, and an inner wall; and at least one longitudinal inner facing vent groove along a portion of the inner wall of the cylindrical cross sectioned portion only, wherein the vent groove vents gases within the shape charge case; and wherein the conical cross sectioned portion is adjacent to the cylindrical cross sectioned portion whereby the second opening and the third opening are adjacent and whereby the fourth opening is larger than the first opening.

12. The apparatus according to claim 11, wherein the at least one vent groove is adapted to vent gases around a liner skirt positioned adjacent to the vent groove.

13. The apparatus according to claim 12, wherein the at least one vent groove comprises a plurality of vent grooves which are spaced equally around the center axis of the cylindrical portion.

14. The apparatus according to claim 11, wherein the at least one vent groove is adapted to vent pressure across the inner wall.

15. The apparatus according to claim 11, wherein the case is further adapted to accept a retainer ring.

16. The apparatus according to claim 11, wherein the case is further adapted to contain a liner and an explosive material.

17. The apparatus according to claim 11, wherein the at least one vent groove is forged into the inner wall.

18. A shape charge assembly comprising:

a case with at least one opening, at least one inner diameter, and at least one longitudinal inner facing vent groove in a cylindrical cross-sectioned portion only of an inner wall of the case;

an explosive material;

a retainer ring with an outer diameter larger than the at least one inner diameter of the case;

a liner with a liner skirt having an outer diameter larger than the at least one inner diameter of the case;

wherein the movement of the liner and explosive material is restricted by the retainer ring's interference fit with the case; and wherein the liner skirt is adjacent to and in contact with the vent groove where at least a portion of the liner skirt does not contact inner wall, and the explosive material is adjacent to the inner wall and the liner.

19. The assembly according to claim 18, wherein the retainer ring is placed adjacent to the liner skirt.

20. The assembly according to claim 19, wherein the retainer ring is adapted to allow venting around the liner skirt.

21. The assembly according to claim 20, wherein the retainer ring contains at least one vent hole.

22. The assembly according to claim 21, wherein the retainer ring's material composition is substantially similar to the liner's material composition.

23. The assembly according to claim 18, wherein the at least one vent groove is adapted to vent gases around the liner skirt.

24. The assembly according to claim 23, wherein the at least one vent groove is a plurality of vent grooves.

25. A shape charge case comprising:

at least one conical cross sectioned portion with an apex having a first opening;

at least one cylindrical cross sectioned portion having an inner surface and a second opening larger than the first opening; and at least one longitudinal inner facing vent groove cut along a portion of the inner surface of the cylindrical cross sectioned portion only; and wherein the at least one conical cross section is located coaxial with and adjacent to the at least one cylindrical cross section portion, wherein the two portions are integral and form a shaped charge case with an apex end first opening and a second opening, opposite of the apex end first opening.

26. The apparatus according to claim 25, wherein the at least one vent groove is a plurality of vent grooves.

27. The apparatus according to claim 26, wherein the plurality of vent grooves is adapted to vent gas along the inner surface.

28. The apparatus according to claim 27, wherein the plurality of vent grooves is further adapted to prevent pressure buildup in the case.

29. The apparatus according to claim 28, wherein the plurality of vent grooves are formed in a forging process.

30. The apparatus according to claim 25, wherein the at least one vent groove is the length of the cylindrical cross sectioned portion.

31. The apparatus according to claim 25, wherein the case is further adapted to contain a liner having a liner skirt.

32. The apparatus according to claim 31, wherein the liner is position such that the liner skirt is adjacent to the inner surface.

33. The apparatus according to claim 32, wherein the at least one vent groove is positioned adjacent to the liner skirt.

34. The apparatus according to claim 33, wherein the at least one vent groove is adapted to vent gas around the liner skirt.

35. The apparatus according to claim 34, wherein the at least one vent groove is a plurality of vent grooves.

* * * * *